US006866621B1

(12) United States Patent
Müller et al.

(10) Patent No.: US 6,866,621 B1
(45) Date of Patent: Mar. 15, 2005

(54) LABORATORY CENTRIFUGE, COMPRISING REFRIGERATION UNIT

(75) Inventors: Heiko Müller, Panitzsch (DE); Horst Kache, Taucha (DE)

(73) Assignee: Eppendorf AG, Hamburg (DE)

( * ) Notice: Subject to any disclaimer, the term of this patent is extended or adjusted under 35 U.S.C. 154(b) by 386 days.

(21) Appl. No.: 10/031,468

(22) PCT Filed: Jun. 26, 2000

(86) PCT No.: PCT/EP00/05877

§ 371 (c)(1),
(2), (4) Date: Jun. 12, 2002

(87) PCT Pub. No.: WO01/05516

PCT Pub. Date: Jan. 25, 2001

(30) Foreign Application Priority Data

Jul. 16, 1999 (DE) ..... 199 32 721

(51) Int. Cl.[7] ..... B04B 13/00; B04B 15/02
(52) U.S. Cl. ..... 494/7; 494/14
(58) Field of Search ..... 494/1, 7, 11, 13, 494/14, 16, 84; 210/149

(56) References Cited

U.S. PATENT DOCUMENTS

| | | | | | |
|---|---|---|---|---|---|
| 3,246,688 | A | * | 4/1966 | Colhurn | 494/14 |
| 3,317,125 | A | * | 5/1967 | Holden | 494/16 |
| 3,409,212 | A | * | 11/1968 | Durland et al. | 494/14 |
| 4,241,866 | A | * | 12/1980 | Giesbert et al. | 494/84 |
| 5,431,620 | A | * | 7/1995 | Schenck et al. | 210/145 |
| 5,509,881 | A | * | 4/1996 | Sharples | 494/14 |
| 2001/0023229 | A1 | * | 9/2001 | Inaniwa et al. | 494/7 |
| 2002/0077239 | A1 | * | 6/2002 | Evans et al. | 494/7 |
| 2002/0092802 | A1 | * | 7/2002 | Evana et al. | 494/1 |
| 2004/0023778 | A1 | * | 2/2004 | Kusumoto et al. | 494/14 |

FOREIGN PATENT DOCUMENTS

| | | | |
|---|---|---|---|
| DE | 3630483 A1 | * | 6/1987 |
| DE | 3714627 | | 11/1987 |
| DE | 3523818 | | 5/1993 |
| DE | 4136514 | | 8/1994 |
| EP | 0833138 | | 9/1997 |
| GB | 2150717 | | 7/1985 |
| JP | 7-246351 | * | 9/1995 |
| JP | 9-24302 | * | 1/1997 |
| JP | 11-290723 | * | 10/1999 |
| WO | 01/05516 | * | 1/2004 |

OTHER PUBLICATIONS

Patent Abstract of Japan No. 09–024302, Jan., 1997.

* cited by examiner

*Primary Examiner*—Charles E. Cooley
(74) *Attorney, Agent, or Firm*—Sidley Austin Brown & Wood, LLP

(57) ABSTRACT

A laboratory with a rotor driven by a centrifuge electric motor and a cooling unit driven by an electrical cooling motor, wherein the centrifuge motor is formed as a frequency-controlled induction motor fed from a frequency converter controlled by a control unit and having a centrifuge inverted rectifier that feeds the centrifuge motor and is connected to a d.c. source fed from a mains power rectifier, characterized in that the cooling motor is formed as a frequency-controlled induction motor, and that the frequency converter has a further cooling inverted rectifier connected to the d.c. source parallel to the centrifuge inverted rectifier for feeding the cooling motor.

5 Claims, 1 Drawing Sheet

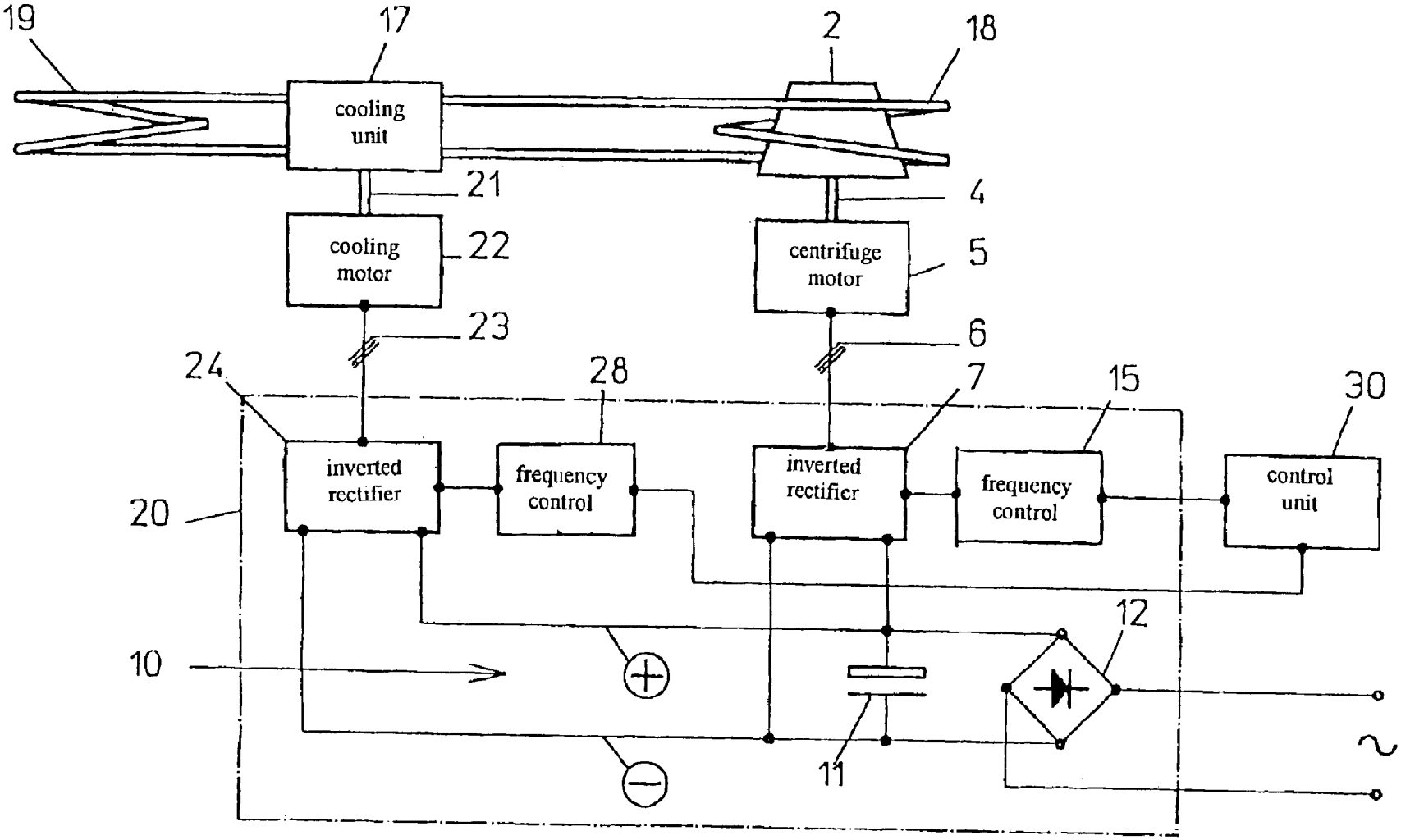
30
control unit
15
frequency control
12
18
4
5
6
7
2
centrifuge motor
inverted rectifier
11
28
frequency control
21
22
23
17
cooling unit
cooling motor
inverted rectifier
24
20
10
19

LABORATORY CENTRIFUGE, COMPRISING REFRIGERATION UNIT

BACKGROUND OF THE INVENTION

1. Field of the Invention

The present invention relates to a laboratory centrifuge with an electric centrifuge motor.

2. Description of the Prior Art

In laboratory centrifuge of this type, it is common, as described in DE-41 36 514 C2, to form the centrifuge motor as a frequency-controlled induction motor that is fed by a frequency converter. This permits to achieve a required precision of adjustment of the motor rotational speed necessary for the centrifuge operation.

Also known are laboratory centrifuges having a cooling unit driven by an electric motor. In those, in accordance with the existing state of the art, the cooling motors have a simple design with a constant rotational speed, with the cooling power being controlled by switching the motor on and off.

DE-35 23 818 C3 discloses an air-conditioner the motor operation of which is frequency controlled.

The object of the present invention is to provide a laboratory centrifuge having a centrifuge motor with a rotational speed control and a cooling unit, and which centrifuge has a simple design and can be cost-effectively produced.

SUMMARY OF THE INVENTION

The object of the invention is achieved by providing a laboratory centrifuge with a rotor driven by a centrifuge electric motor, and a cooling unit driven by an electrical cooling motor, with the centrifuge motor being formed as a frequency-controlled induction motor fed from a frequency converter controlled by a control unit and having a centrifuge rectifier that feeds the centrifuge motor and is connected to a d.c. source fed from a mains power rectifier, with the cooling motor being formed as a frequency-controlled induction motor, and with the frequency converter for feeding the cooling motor having a further cooling inverted rectifier connected in parallel with the centrifuge inverted rectifier to the d.c. source.

According to the invention, not only the centrifuge motor but also the cooling motor have their rotational speeds controlled by controlling the frequency. This results in a possibility of better cooling control and permits to significantly simplified the construction. To this end, the already available frequency converter should be supplemented with a further inverted rectifier. Additional switching and control devices for the cooling motor are not necessary. A significant constructional simplification of the motor control is obtained which results in the costs reduction. In laboratory centrifuges, this is of a particular importance, as these can be successfully marketed essentially only as table apparatuses as small and economical as possible.

The control unit, which controls the frequency converter, can control both inverted rectifiers with the same frequency. The drawback of this consists in that both the rotational speed and the cooling power are increased and decreased together. Therefore, advantageously, the control unit controls the two inverted rectifiers independently from each other. These features make it possible to separately control, as needed, the rotational speed and the cooling power.

With centrifuges, it is necessary to bring the rotor to a stop as soon as possible after a centrifuge process ends in order to be able to remove centrifuged samples in short time. When the control frequency for the centrifuge inverter rectifier decreases, it supplies a high braking current in a d.c. source so that its voltage can reach an impermissible high value. According to the state of the art, the returned brake power is consumed, if required, in connectable brake resistances which increases the construction costs. Therefore, advantageously, control unit controls the two inverted rectifiers with a predetermined reduction of frequency if the frequency of the centrifuge inverted rectifier is reduced. In this way, during braking of the centrifuge motor, the returned brake power, at least partially is converted into current consumed from the d.c. source by the cooling motor that functions as a brake resistance. Therefore, the number of additional brake resistances can be substantially reduced or be completely eliminated, whereby the costs of a centrifuge is further reduced. A complete separate control of the driving powers of the centrifuge motor and the cooling motor can lead to a simultaneous full load in each of the two motors, and both the d.c. source and the mains power rectifier must be designed for this case. Therefore, advantageously, the control unit reduces the frequency of the cooling inverted rectifier during acceleration of the centrifuge motor. Such control connection of both motors ensures that both accelerations of the rotor when the centrifuge motor requires a lot of power, the cooling motor is driven with less power. As a result, the maximal power to-be-fed from the d.c. source is reduced, so the components can be reduced, which again can reduce the cost of the centrifuge.

Advantageously, the control unit turns off the cooling inverted rectifier below a minimal frequency. In this way it is insured that the cooling motor runs at a speed below the minimal rotational speed only for a short time. This is an advantage when conventional cooling units with a compressor are used for lubrication reasons, should operate above a minimal rotational speed.

BRIEF DESCRIPTION OF THE DRAWINGS

The single drawing shows, by way of example and schematically, a very simplified block-diagram of a centrifuge according to the present invention.

DETAILED DESCRIPTION OF THE PREFERRED EMBODIMENT

The centrifuge has a rotor 2 that has inwardly located seats (not shown) for a conventional centrifuge vessel. The rotor 2 is driven by a centrifuge motor 5 via a shaft 4. The motor 5 is formed as a three-phase induction motor.

The centrifuge motor 5 is fed from a centrifuge inverted rectifier 7 of a frequency converter 20 via three conductors 6. In the frequency converter 20, the centrifuge inverted rectifier 7 has its input conductors connected with plus and minus wires of a d.c. source 10.

The d.c. source 10 has, between the plus and minus wires, a conventional charging capacitor 11 and is fed from a mains power rectifier 12 that is connected by appropriate conductors with a.c. mains.

The centrifuge inverted rectifier 7 is connected to a frequency control 15 by control conductors. The frequency control feeds the frequency and voltage to the centrifuge inverter rectifier 7, with which the centrifuge motor 5 is controlled.

There is provided a cooling unit 17, in a very simplified representation of which is shown in the drawing cools the rotor 2 with a cooler 18 formed as a coiled pipe cooler, and with a heat exchanger 19, likewise formed as a coiled pipe cooler, diverts heat outside of a non-shown housing. The cooling circuit is provided with a non-shown compressor driven by an electrical cooling motor 22 via a shaft 21.

The cooling motor 22 is likewise formed as an induction motor and is fed from a cooling inverted rectifier 24 via three conductors 23. This one, in the frequency converter, 20, has its input conductors connected to the plus and minus wires of the d.c. source 10, i.e., it is connected parallel to the centrifuge inverted rectifier 7. It is controlled via control lines by a frequency control 28 in a similar way as the centrifuge rectifier 7 is controlled.

In the centrifuge discussed above, the cooling power of the cooling unit 17 and the rotational speed of the rotor 2 may be adjusted completely separately in accordance with corresponding preselection. To this end, a control unit 30 is used which is connected with frequency controls 15 and 28 by corresponding data lines for inputting therein predetermined rotational speeds.

The control unit 30 can reduce the power for the cooling motor 22 by reducing the control frequency or completely shut out the motor 22, in particular during full load of the centrifuge motor 5 when the rotor 2 is accelerated. Thereby, overloading of the d.c. source 10 is prevented, and it can, e.g., have smaller charging capacitor 10 and mains power rectifier 12, and reduced dimensions and manufacturing costs.

The control unit 30 can be so formed that upon turning the centrifuge on, first, the cooling unit 17 remains turned off until the rotational speed of the rotor 2 reaches the region of its predetermined rotational speed. At this point, the power consumption of the centrifuge motor 5 is reduced, and the power of the cooling motor 22 can be increased, and can subsequently be again reduced when the desired temperature is reached, via temperature sensors (not shown) connected to the control unit 30.

After the centrifuge process has ended, a rapid braking of the rotor 2 is desired in order to be able to quickly unload the rotor. To this end, the control unit 30 is so formed that for braking the centrifuge, the frequency of the centrifuge inverted rectifier 7 is reduced. This leads to feeding the brake current back to the d.c. source 10. With strong braking, the d.c. source 10 can be overloaded due to voltage increase.

In order to avoid use of conventional brake resistances, the control unit ensures that during braking of the centrifuge motor 5, the cooling inverted rectifier 24 is controlled with a predetermined frequency, so that the cooling motor 22 consumes current from the d.c. source 10. The cooling motor 22 functions as a brake resistance. Thus, the additional brake resistance can be dispensed with.

The control unit 30 is additionally so formed that the cooling inverted rectifier 24 can be operated only above a minimal frequency corresponding to a minimal rotational speed of the cooling motor 22. In this way, a cooling compressor (not shown), which is provided in the cooling unit 17, operates only above a certain minimal rotational speed, so that the problems of lubrication, which are associated with small rotational speeds, are avoided.

What is claimed is:

1. A laboratory centrifuge with a rotor (2) driven by a centrifuge electric motor (5) and a cooling unit (17) driven by an electrical cooling motor (22), wherein the centrifuge motor (5) is formed as a frequency-controlled induction motor fed from a frequency converter (20) controlled by a control unit (30) and having a centrifuge inverted rectifier (7) that feeds the centrifuge motor (5) and is connected to a d.c. source (10) fed from a mains power rectifier (12), characterized in that the cooling motor (22) is formed as a frequency-controlled induction motor, and that the frequency converter (20) for feeding the cooling motor (22) has a further cooling inverted rectifier (24) connected in parallel with the centrifuge inverted rectifier (7) to the d.c. source (10).

2. A laboratory centrifuge according to claim 1, characterized in that the control unit (30) controls the two inverted rectifiers (7, 24) independently from each other.

3. A laboratory centrifuge according to claim 2, characterized in that the control unit (30) controls the cooling inverted rectifier (24) with a predetermined reduction of the frequency if the frequency of the centrifuge inverted rectifier (7) strongly reduced.

4. A laboratory centrifuge according to claim 2, characterized in that the control unit (30) reduces the frequency of the cooling inverted rectifier (24) during acceleration of the centrifuge motor (5).

5. A laboratory centrifuge according to claim 2, characterized in that the control unit turns off cooling inverted rectifier (24) below a minimal frequency.

* * * * *